US005428262A

United States Patent [19]

Geier

[11] Patent Number: 5,428,262

[45] Date of Patent: Jun. 27, 1995

[54] INCANDESCENT LAMP WITH IMPROVED FILAMENT-GETTER CONNECTION

[75] Inventor: Robert L. Geier, Richmond, Ky.

[73] Assignee: Philips Electronics North America Corporation, New York, N.Y.

[21] Appl. No.: 94,414

[22] Filed: Jul. 19, 1993

[51] Int. Cl.[6] ..... H01K 1/54

[52] U.S. Cl. ..... 313/557; 313/548

[58] Field of Search ..... 313/559, 558, 557, 553, 313/548, 547; 445/48, 55

[56] References Cited

U.S. PATENT DOCUMENTS 3,748,519 7/1973 Martin et al. ..... 313/557

*Primary Examiner*—Jerome Grant, II

*Attorney, Agent, or Firm*—Brian J. Wieghaus

[57] ABSTRACT

An electric incandescent lamp includes a metal getter strip secured to a filament. The getter strip has a closed circumferential bounding edge which defines a closed aperture through which the filament extends and an integral retaining portion biased against said filament for retaining the bounding edge between a pair of coil turns. In a favorable embodiment, the strip has opposing portions each with a respective closed aperture through which the filament extends. Tail portions bent against the filament bias the opposing bounding edge of the apertures between respective turns to secure the getter to the filament. The side edges of the getter are spaced from the lamp envelope to avoid blackening of the inner wall adjacent the getter strip.

19 Claims, 2 Drawing Sheets

INCANDESCENT LAMP WITH IMPROVED FILAMENT-GETTER CONNECTION

BACKGROUND OF THE INVENTION

1. Field of the Invention

The invention relates to electric incandescent lamps, and more particularly, to improvements in the fixation of a metal getter element to an incandescent filament.

2. Description of the Prior Art

Despite all precautions taken during the manufacture of incandescent lamps, small amounts of impurities are trapped within the lamp envelope after it is sealed. The impurities may remain on the filament, on the inner wall of the lamp envelope, or in residual gases within the envelope. After sealing, incandescent lamps are typically "flashed" by passing a current through the filament, to crystallize and set the filament. Without appropriate measures, the impurities will react with the hot filament and form vapors which condense on the coolest portions of the lamp envelope and form a black deposit. This deposit is not only cosmetically unsightly, but reduces lamp efficacy. Accordingly, it is common to provide a getter within the lamp envelope to clean-up, or absorb, any impurities which remain after sealing.

There are different types of getters for different types of incandescent lamps. For the typical incandescent lamp which is evacuated, the getter consists of a phosphate material deposited on the filament. When the filament is initially "flashed" the phosphate material deposited thereon is heated and reacts with, or cleans-up, the impurities within the lamp envelope. For evacuated lamps, the amount of impurities is typically small and the phosphate getter is sufficient to adequately clean-up the impurities during flashing, so that no further gettering over lamp life is needed.

Some incandescent lamps are not evacuated but contain a gaseous fill of argon at a pressure of about one atmosphere. With such a fill, the typical phosphate getter used for evacuated lamps is not sufficient to clean up all of the impurities within the lamp. Instead, a getter element consisting of a piece of metal which will clean-up impurities when heated by the filament is secured within the lamp envelope to continuously getter impurities over lamp life. Suitable metals include tantalum, as known from U.S. Pat. No. 3,317,264, and in the case of halogen lamps, copper, as known from U.S. Pat. No. 4,451,760 (Griffin et al).

Some non-evacuated lamps include filament support structure to which the metal getter element can be secured. Other lamps, however, such as radiant heat lamps, have an elongate filament extending between opposing sealed ends of a tubular envelope. In these lamps, there is no frame structure, and the metal getter element must be secured directly to the filament.

U.S. Pat. No. 3,317,264 (Martin et al.) disclose such a lamp in which the getter element is a disc which also supports the filament on the lamp axis. The disc includes a slot that receives the filament and has a thickness selected such that adjacent coil turns of the filament are spread apart and clamp the disc therebetween. Instead of the many discs used in Martin, many commercial lamps employ only one or two of the getter discs and support the filament on the axis with conventional spiral wound wire supports. It has been found, however, that for many combinations of filament pitch and wire diameter, the discs are not adequately secured on the filament, but fall off during the lamp manufacturing process, in shipment, or during use if subject to vibration.

If the getter falls off the filament during or after sealing, the lamp must be scrapped by the manufacturer because the getter will not function unless it is secured to and heated sufficiently by the filament. If the disc falls off after the lamp leaves the factory, the lamp will have a reduced efficiency and a shortened life. It has been found that even if the discs include tooth-like burrs as shown in U.S. Pat. No. 2,980,820 (Brundige et al.), or are manually bent against the coil turns by peening, the scrap rate is still unacceptable. Furthermore, the additional step of peening is labor intensive and stretches the filament coil, forming a cold spot which adversely impacts filament life.

Additionally, the outer edge of the discs are disposed against or very near the inner wall of the lamp envelope. It has been found that reaction of these tantalum getter discs with the lamp impurities upon initial flashing of the filament forms dark rings on the lamp envelope adjacent these edges, which further blacken over lamp life. The dark circles are not cosmetically attractive.

Accordingly, it is the object of the invention to provide an improved metal getter element which reduces lamp cost, through labor savings in installation on the filament and by reducing the scrap rate through better fixation of the getter on the filament, and which reduces unsightly blackening of the lamp envelope.

SUMMARY OF THE INVENTION

According to the invention, the above objects are accomplished in that the getter comprises a metal strip having a first portion extending across the filament with a closed, circumferential bounding edge which defines a closed aperture through which the filament extends and retaining means integral with the strip and biased against the filament for retaining the bounding edge of the aperture between a pair of filament turns. The integral retaining means may be a tail portion of the strip having an end resiliently biased between an adjacent pair of filament turns.

Such a getter strip may easily be assembled on the filament by simply feeding the filament through the aperture in the strip. Because the closed bounding edge of the aperture completely encloses the filament, the getter strip cannot fall completely off the filament, in contrast to the disc-shaped getters of the prior art. The integral retaining means ensures in a simple fashion that the getter does not skip axially along the filament.

According to another embodiment of the invention, the strip includes first and second opposing portions each extending across said filament. Each of these portions includes a respective closed aperture through which the filament extends and whose bounding edges engage between a respective pair of coil turns. The retaining means may be comprised by the opposing portions being resiliently joined for biasing the bounding edge of each aperture, or strip face adjacent thereto, generally axially against a respective coil turn. The retaining means may additionally, or alternatively, include a tail portion extending from at least one of the opposing portions which is bent against the filament for biasing the bounding edge of its respective aperture generally transverse to the filament between adjacent turns.

An additional advantage of the lamp according to the invention is that the edges of the getter need not engage the inner wall of the lamp envelope to be secured in the lamp as with the disc shaped-getters of the above-mentioned U.S. Pat. No. 3,313,264. By selecting the width of the strip such that it is spaced from the inner wall of the lamp envelope, blackening of the lamp envelope along these edges is avoided upon flashing of the filament. The lamp then has a higher quality appearance.

These and other advantages and features of the invention will become apparent from the following drawings, detailed description, and claims.

DESCRIPTION OF THE PREFERRED EMBODIMENTS

Figure 1:
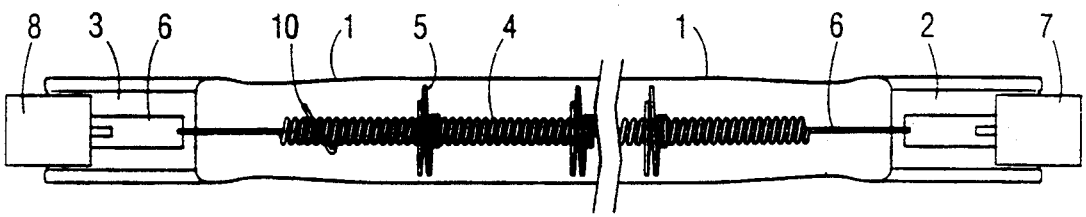
FIG. 1 is an elevation of a tubular infrared heat lamp.

The incandescent radiant heat lamp shown in FIG. 1 includes an elongate tubular lamp envelope 1 having opposing seals 2, 3 at each end thereof sealing the lamp envelope in a gas-tight manner. A coiled tungsten filament 4 extends longitudinally within the lamp envelope between seals 2, 3 and includes successive filament turns. Means for connecting the filament to a source of electric potential outside of the lamp envelope include conventional conductive feed-throughs 6 connected to each end of the filament and extending through the seals 2, 3 in a gas-tight manner. Conventional spiral-wound tungsten supports 5 support the filament on the axis of the lamp envelope. Insulative ceramic bases 7, 8 are provided on each of the seals 2, 3o The lamp includes a fill of argon at a pressure of about one atmosphere. To clean up impurities within the lamp envelope, a getter 10 comprised of a metal strip is secured to the filament 4.

Figure 2:
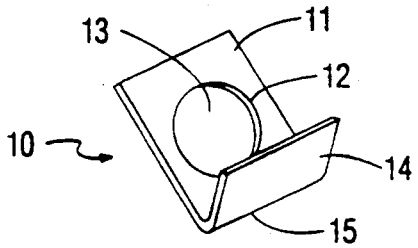
FIG. 2 is an enlarged perspective view of a getter strip according to a first embodiment.

FIG. 2 illustrates a getter according to a first embodiment of the invention. The getter strip includes a first portion 11 with a closed, circumferential bounding edge 12 which defines a closed aperture 13 and integral retaining means in the form of a tail portion 14. The tail portion forms a "V" shape with the first portion 11 about a bend 15.

Figure 3:
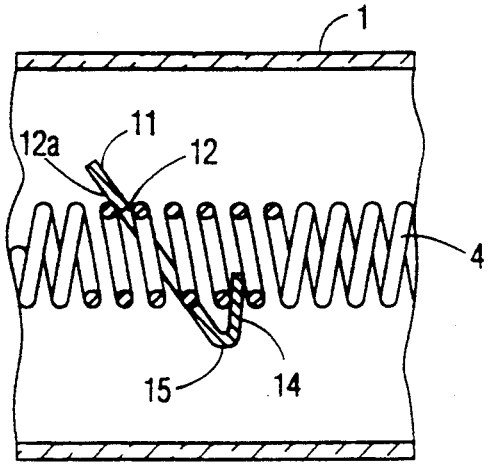
FIG. 3 is an enlarged elevational side view, partly in cross-section showing the getter strip of FIG. 2 assembled on the filament.

The getter is secured on the filament before the envelope is sealed by passing the filament through the aperture 13 with the first portion 11 substantially transverse to the axis of the filament so that the tail portion 14 clears the filament turns. The bounding edge 12 is then inserted between a desired pair of filament turns and the tail portion 14 is bent resiliently towards the first portion and its end inserted between an adjacent pair of turns. The length of the tail portion and the spring force of the strip are selected such that the face 12*a* of the strip adjacent the bounding edge 12, or the bounding edge 12 itself, is biased against the respective filament turn while the end of tail portion 14 is biased against its respective turn (FIG. 3). This secures the getter 10 to the filament.

Figure 4:
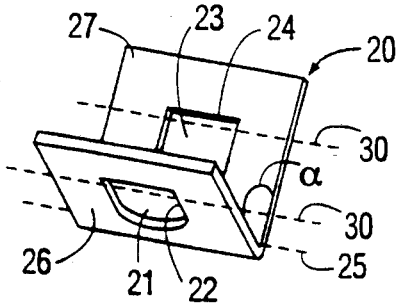
FIG. 4 is an enlarged perspective view of a getter strip according to another embodiment.

In the second embodiment shown in FIG. 4, the getter 20 is a V-shaped part having first and second opposing portions 26, 27, with respective closed apertures 21, 23 equally spaced about a bend line 25 in the middle of the strip. The apertures are defined by respective closed bounding edges 22, 24. The strip is easily stamped from strip stock.

Figure 5:
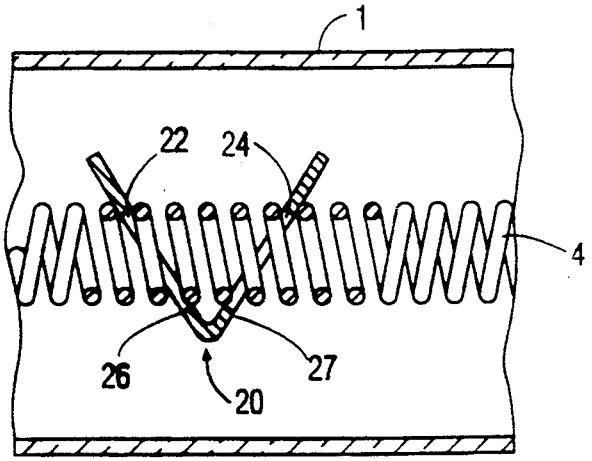
FIG. 5 is an enlarged elevational side view, partly in cross-section, showing the getter strip of FIG. 4 assembled on the filament.

The getter strip is assembled onto the filament simply by inserting the filament coil through both apertures 22 of the two opposing portions 26, 27 of the getter strip 20 (FIG. 5). The size of the apertures 21, 23 and the angle $\alpha$ between the opposing portions are selected such that the filament turns pass through the apertures when the ends of the opposing portions 26, 27 are biased towards each other a predetermined amount. After locating the strip on the filament with the bounding edges between respective pairs of coil turns, release of the biasing pressure causes the opposing portions 26, 27 to move outwardly and axially bias the bounding edges 22, 24, or the strip face adjacent thereto, against a respective coil turn with spring force. With a tantalum strip having a thickness of about 0.1 mm, there is sufficient force to reliably retain the strip.

With some combinations of filament diameter and filament wire diameter the filament coils may be so elastic that it is not possible to obtain a sufficient axial biasing force between the two opposing portions 26, 27 and the coil turns to reliably secure the getter on the filament. This may generally occur with filaments having diameter of less than about 1 mm. For such filaments, the getter may be reliably secured by bending one or both tail portions 28, 29 transversely against the filament according to a third embodiment shown in FIG. 6. Prior to assembly on the filament, the tail portions are pre-bent at the location of the apertures, for example along the dashed lines 30 in FIG. 4. After locating the edges of apertures 21, 23 between respective pairs of turns, the tail portions are manually bent against the filament so that the portion of the bounding edge opposite the tail portion is firmly wedged between its pair of coil turns. The length of filament between the apertures is slightly bent as a result of the generally transverse biasing force exerted by the tail portions on the filament. During assembly, the opposing portions 26, 27 may also be biased towards each other as discussed with respect to FIG. 5 so that the faces of these portions are also biased generally axially against the filament turns.

Figure 6:
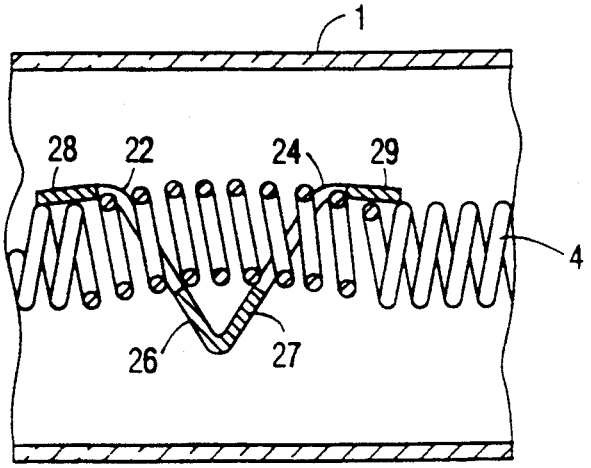
FIG. 6 is an elevational side view, partly in cross-section, showing tails of each of the opposing portions bent against the filament according to a third embodiment of the invention.

With the getter strip according to FIG. 6, a labor savings of about 25% for the step of the securing the getter to the filament was achieved as compared to disc-shaped getters which were manually bent by peening. In addition to the labor savings, a far superior fixation of the getter to the filament is achieved. Furthermore, it has been found that fixation of the getter according to the invention on the filament does not form cold spots as with the disc-shaped getters formed by peening.

The strip is dimensioned such that its side edges 19 which extend longitudinally along the lamp envelope are sufficiently spaced from the inner wall of the lamp envelope so that no blackening of the inner wall occurs upon flashing of the filament. In the lamp shown in FIG. 1, the inside diameter of the lamp envelope was about 7.5 mm and the width of the getter strip 10 was 6 mm, leaving a clearance of about 0.75 mm between each side edge 19 and the lamp envelope. With this clearance, no blackening of the lamp envelope was observed upon flashing of the filament, in contrast to the distinct circles formed with the prior art discs.

Those of ordinary skill in the art will appreciate that various modifications may be made to the lamp base without departing from the scope of the appended claims. For example, instead of being bent along a bend line to obtain a "V" shape, the bend may be curved to obtain a "U" shape. Alternatively, the strip may be bent along two bend lines between the apertures, resulting in a square shape. Furthermore, the strip may be longer and include repetitions of the basic shape.

What is claimed is:

1. An electric lamp having a sealed lamp envelope, an incandescent filament arranged within said lamp envelope and having a plurality of successive filament turns, means for connecting said filament to a source of electric potential outside of said lamp envelope, and a getter element secured to said filament for gettering impurities within said lamp envelope, wherein the improvement comprises:

said getter element comprises a metal strip having a first portion extending across said filament with a closed, circumferential bounding edge which defines a closed aperture through which the filament extends, and retaining means integral with said strip and resiliently biased against said filament for retaining said bounding edge between a pair of filament turns.

2. An electric lamp according to claim 1, wherein said strip includes a single said aperture through which said filament extends and a tail portion having an end resiliently biased between another pair of filament turns for retaining the bounding edge of said aperture between its respective pair of turns.

3. An electric lamp according to claim 1, wherein said strip includes first and second opposing portions extending a across said filament, each of said opposing portions having a respective said closed aperture through which said filament extends, and said retaining means is comprised by said opposing portions being resiliently joined and arranged in the filament for generally axially biasing at least one of (i) the bounding edge of each aperture and (ii) the face of the strip adjacent thereto against a respective coil turn.

4. An electric lamp according to claim 3, wherein said retaining means is further comprised by a said one of said first and second portions having a tail portion, adjacent its respective aperture, bent against said filament for transversely biasing its respective bounding edge against a coil turn.

5. An electric lamp according to claim 4, wherein said getter strip has a length dimension and is bent along a line transverse to the length dimension at the juncture of said first and second portions so that said strip is "V"-shaped.

6. An electric lamp according to claim 5, wherein said getter strip includes side edges extending longitudinally along the inner wall of said lamp envelope, said longitudinal edges being spaced from said inner wall such that said lamp envelope is substantially free of blackening adjacent said side edges upon flashing of the filament.

7. An electric lamp according to claim 6, wherein said metallic strip consists of tantalum.

8. An electric lamp according to claim 1, wherein said strip includes first and second opposing portions extending across said filament, each of said opposing portions having a respective said closed aperture through which said filament extends, and said retaining means is comprised by a said one of said first and second portions including a tail portion, adjacent its respective aperture, bent against said filament for transversely biasing its bounding edge against a respective coil turn.

9. An electric lamp according to claim 1, wherein said lamp envelope is an elongate tubular lamp envelope defining a lamp axis and having a pair of opposing sealed ends, and said filament extends between said sealed ends aligned with said lamp axis.

10. An electric lamp according to claim 1, wherein said getter strip includes side edges extending longitudinally along the inner wall of said lamp envelope, said longitudinal edges being spaced from said inner wall such that said lamp envelope is substantially free of blackening adjacent said side edges upon flashing of the filament.

11. A tubular incandescent lamp, comprising:

a) an elongate tubular lamp envelope defining a lamp axis and having a pair of sealed ends sealing said envelope in a gas-tight manner;

b) an elongate coiled filament having a plurality of successive turns and axially extending within said lamp envelope between said sealed ends;

c) means for supporting said filament substantially on said lamp axis;

d) a pair of conductive feed-throughs each connected to said filament and extending through a respective sealed end to the exterior of said lamp envelope; and e) a metallic getter strip secured to said filament, said getter strip including first and second opposing portions extending in a plane across said filament, each of said portions having a respective closed circumferential bounding edge defining a closed aperture therein and through which said filament extends, and said portions being resiliently joined and arranged in said filament for generally axially biasing at least one of (i) said bounding edges and (ii) the face of said opposing portions adjacent said bounding edges against a respective pair of coil turns for securing said metallic strip on said filament.

12. A tubular incandescent lamp according to claim 11, wherein a said one of said first and second portions further includes a tail portion, adjacent its respective aperture, bent against said filament for transversely biasing the bounding edge of said aperture against a respective coil turn.

13. A tubular incandescent lamp according to claim 12, wherein said metallic strip has a length dimension and is bent along a line transverse to the length dimension at the juncture of said first and second opposing portions so that said strip is "V"-shaped.

14. A tubular incandescent lamp according to claim 13, wherein said metallic strip consists of tantalum.

15. A tubular incandescent lamp according to claim 14, wherein said getter strip includes side edges extending longitudinally along the inner wall of said lamp envelope, said longitudinal edges being spaced from said inner wall such that said lamp envelope is substantially free of blackening adjacent said side edges upon flashing of the filament.

16. A tubular incandescent lamp according to claim 15, wherein said lamp is a radiant heat lamp.

17. A tubular incandescent lamp according to claim 11, wherein said getter strip includes side edges extending longitudinally along the inner wall of said lamp envelope, said longitudinal edges being spaced from said inner wall such that said lamp envelope is substantially free of blackening adjacent said side edges upon flashing of the filament.

18. A tubular incandescent lamp according to claim 12, wherein said lamp is a radiant heat lamp.

19. A tubular incandescent lamp according to claim 11, wherein said lamp is a radiant heat lamp.

* * * * *